United States Patent [19]

Johnson

[11] Patent Number: 4,949,969

[45] Date of Patent: Aug. 21, 1990

[54] PUZZLE

[76] Inventor: Harvey P. Johnson, 11374 Brydan Dr., Apt. 258, Taylor, Mich. 48180

[21] Appl. No.: 295,305

[22] Filed: Jan. 10, 1989

Related U.S. Application Data

[63] Continuation-in-part of Ser. No. 235,517, Sep. 24, 1988, abandoned.

[51] Int. Cl.[5] ..... A63F 9/08

[52] U.S. Cl. ..... 273/153 S; 273/153 R

[58] Field of Search ..... 273/153 S

[56] References Cited

U.S. PATENT DOCUMENTS

| | | | |
|---|---|---|---|
| 4,373,729 | 2/1983 | Hanson et al. | 273/153 S |

FOREIGN PATENT DOCUMENTS

| | | | |
|---|---|---|---|
| 1199351 | 1/1986 | Canada | 273/153 S |
| WO82/00101 | 1/1982 | PCT Int'l Appl. | 273/153 S |
| 1319888 | 6/1987 | U.S.S.R. | 273/153 S |
| 2107997 | 5/1983 | United Kingdom | 273/153 S |

OTHER PUBLICATIONS

"Puzzles Old and New" by J. Slocum & J. Botermans, copyright 1986, Dist. by University of Washington Press, Seattle, Wash., p. 138.

*Primary Examiner*—Edward M. Coven
*Assistant Examiner*—Raleigh W. Chiu
*Attorney, Agent, or Firm*—Dykema Gossett

[57] ABSTRACT

A self-contained cylindrical puzzle has a plurality of slide elements having faces displaying indicia. The elements form a mosaic geometric surface characterized by the absence of one of the elements leaving a slot. A slide element adjacent the slot may be slid into the slot, leaving behind a slot in the position from which the slide element was slid. Rotation of a row adjacent the row containing the slot will bring a new slide element adjacent the slot to be slid thereinto. Accordingly, the plurality of slide elements may be manipulated about so as to juxtapose indicia to bring about an overall composition that is a solution to the puzzle. One embodiment has a solution that represents the trade dress of a popular beverage can.

10 Claims, 3 Drawing Sheets

PUZZLE

REFERENCE TO EARLIER APPLICATION

The present application is a continuation-in-part of a copending application, Ser. No. 235,517 filed Aug. 24, 1988 and entitled "PUZZLE", abandoned.

FIELD OF THE INVENTION

The present invention relates to puzzles and puzzle games. More particularly, the present invention relates to three-dimensional puzzles that include a plurality of interconnected members, each member carrying indicia which relates in certain fashion to indicia carried by another and each member capable of being manipulated into juxtaposition with another so that the relationship between indicia may be used to form a correct solution. The present invention also relates to amusement devices, more particularly puzzles, used as vehicles for advertising.

BACKGROUND OF THE INVENTION

Many kinds of three-dimensional puzzles are in existence for the purpose of providing amusement with varying degrees of challenge. Particular types of puzzles, those most related to the invention herein disclosed, are characterized by movable parts carrying indicia that are placed into juxtaposition with one another so that the indicia form a puzzle solution. Solutions range from those that result from such simple operations as aligning color indicia into rows or columns to solutions in the form of graphic representations arrived at by having each movable part in a predetermined position with respect to all other movable parts, for example, a solution requiring sequential positioning of numeral indicia or an overall pictorial representation with each part carrying a small portion of the picture. A picture may form a promotional representation or advertisement. Such a range provides for amusement for a range of operators, from young children to adults.

Such puzzles as have been described have certain advantages over other types of puzzles. For one, puzzles formed of interconnected parts assure that all parts will be available to the operator in forming a solution, as contrasted with traditional puzzles where parts may be lost so as not to be available in forming a solution. Related to this advantage is the advantage of being transportable as a unit. Without parts that may be lost from one another, such puzzles are available to provide amusement on long automobile trips, particularly for youthful passengers confined to the back seat of the automobile.

PRIOR ART

Perhaps one of the most popular three-dimensional puzzle-type games with interlocking parts is the "Rubik's Cube." This type of puzzle is in the form of a cube that is made up of a multiplicity of elements which make up the facial sides of the cube and appear to be smaller cubes. Two human hands grasping the overall cube with palms facing each other can be used to twist subsections of the cube, which are made up of the multiplicity of elements, away from each other so that one subsection that had been a part of one side of the cube can be oriented to be a part of another side of the cube. The twisting can take place with regard to each side of the cube so as to manipulate elements into different relative positions with respect to one another. In this manner, colors can be aligned in a multiplicity of colored elements, or graphic indicia may be so aligned.

Because of the degrees of freedom presented by the twistable mechanism of the Rubik's Cube, manipulation into indicia alignment is a relatively complex intellectual operation. Accordingly, the Rubik's Cube is much more adapted to age groups having a developed sense of spatial relations. At the same time, the twisting mechanisms of the Rubik's Cube serve to develop only one dimension of manipulative skill, that of twisting into alignment. As such, the forecasting ability of moving from one spatial relationship into another, gets adequate exercise, but there is little activity in the realm of eye-hand coordination so as align various elements of the puzzle.

U.S. Pat. No. 4,651,992, issued to Danino et al., discloses a puzzle-type game in which five manipulatable members may be rotated about a common axis so as to be placed in any desired angle with respect to one another. Each of the members may have painted on its outer faces, opposite the axis of rotation, indicia representing one element of multi-element relationships produced by aligning the angles of the various rotatable members relative to one another. The indicia may be also positioned axially, but this calls for taking apart the various elements so as to put them in a different axial relationship. As a result, parts of this may be lost when the elements are taken apart.

U.S. Pat. No. 4,632,399, issued to Bern, discloses a manipulative puzzle formed of a succession of coaxial wheel-like elements in somewhat similar relationship to the elements of the Danino et al. puzzle. In a way similar to the Danino et al. puzzle, the Bern puzzle requires separating parts from the puzzle in order to move parts axially with respect to one another. Accordingly, the Bern puzzle suffers from the same shortcoming of the Danino et al. device, that is, parts may be easily lost so as to frustrate the self-contained basis of the puzzle.

U.S. Pat. No. 4,445,691, issued to Stark et al., discloses a method for forming a puzzle that involves cutting a sheet on which there is a design into a plurality of parallel strips, cutting some or all of the strips transversely to form multiple pieces, rearranging the pieces of each cut strip end-for-end to form secondary strips, forming each of the strips into an endless ring, and assembling the rings on a spindle for independent rotation about a common axis. Relative rotation of the rings will enable the segments or portions of the design on each ring to be aligned or registered in such a manner as to reproduce and display the original design. This puzzle is a very simple puzzle and should not hold the attention of an operator who is above the age of a toddler. Moreover, this puzzle does not provide for transaxial positioning of the various segments of the rings.

OBJECTS OF THE INVENTION

Accordingly, it is one object of the present invention to provide a puzzle having interconnected parts so that individual parts will not be lost and thereby become unavailable for use with other parts.

It is another object of the present invention to provide a puzzle that presents a range of challenges so as to provide entertainment for adults and children alike.

It is yet another object of the present invention to provide a puzzle that develops skills in predicting spatial relationships and develops manipulative skills.

It is yet still another object of the present invention to provide a puzzle that entertains by providing a range of challenges in manipulating indicia to effect a solution to the puzzle and by so entertaining draws attention to the indicia which may be used as a vehicle for advertising.

SUMMARY OF THE INVENTION

According to the invention, a self-contained puzzle is in the configuration of a cylinder having a cylindrical surface and a central axis. The puzzle has a plurality of slide elements disposed longitudinally in rows that are each disposed concentrically about the central axis. Faces on the slide elements display indicia. Each slide element is retained by a base structure that keeps the face of the slide element in registry with the cylindrical surface. The base structure also restricts the slide element so that it is only capable of being slidably transpositioned, relative to other slide elements, in a direction parallel to the central axis, from one row into another.

The faces of the slide elements form a mosaic, geometric surface characterized by the absence of one of the slide elements, so as to leave a slot into which an adjacent slide element may be slid to transposition it relative to the other slide elements. When the adjacent slide element is slid into the slot, it leaves a slot in the position from which it was slid.

The base structure includes a multiplicity of rotatable base wheels aligned end-to-end concentrically about an axle which extends along the central axis. The base wheels are rotatable about the axle, which includes one part of a detent mechanism that is cooperative with another part to temporarily hold each rotatable base wheel structure in a relative angular disposition with respect to another rotatable base wheel structure.

At least one end rotatable base wheel is disposed at each end of the aligned multiplicity of rotatable base wheels. Each end rotatable base wheel has at least one female fitting that opens toward the end at which the end rotatable wheel is disposed. An end cap, having a male fitting, is received onto the end rotatable base wheel.

Each base wheel includes a cylindrical hub collar of determinable length. The hub collar has a hub inner surface that faces radially inwardly. A plurality of detent grooves are disposed in the hub collar parallel to and spaced concentrically about the central axis and the axle. The hub collar has an outer surface from which a plurality of planar spokes radiate. An outer collar is disposed concentrically about the hub collar and has a surface which faces radially inwardly to receive the plurality of planar spokes.

In a radially outwardly-facing surface of the outer collar are a plurality of mortise grooves disposed parallel to and concentrically about the central axis and the axle. Each slide element has a dove tail tenon that projects radially inwardly toward the central axis to be inserted into and retained by one of the mortise grooves in one of the outer collars, such that the slide element with its dove tail tenon is slidable along one of the mortise grooves of one outer collar to the mortise groove of another outer collar when the mortise grooves of the two collars are aligned.

As the base wheels are rotatable, rotation of a row adjacent the row containing the slot will bring a new slide element adjacent the slot to be slid thereinto. Accordingly, the puzzle may be manipulated to change angular or rotational alignments of the slide elements on one base wheel with respect to the slide elements on another and manipulated to slide a slide element into the slot at one position to fill the position with a particular slide element or to open a slot in the position formerly occupied by the particular slide element, so that the new slot might be filled with another particular slide element. Changing axial alignments of the slide elements with respect to one another can be used to position the indicia on the faces of the slide elements so that an arrangement of indicia may be effected as a solution for the puzzle.

In one embodiment, a solution is in the form of a popular beverage can, the arrangement of indicia effecting an image of the trade dress of the beverage. According to this embodiment, the amusement brought to the operator has commercial advertising value to the marketer of the beverage.

BRIEF DESCRIPTION OF THE DRAWINGS

The invention that is to be herein described by way of example only, will be described with reference to the accompany drawings wherein.

BRIEF DESCRIPTION OF THE PREFERRED EMBODIMENT

Figure 1:
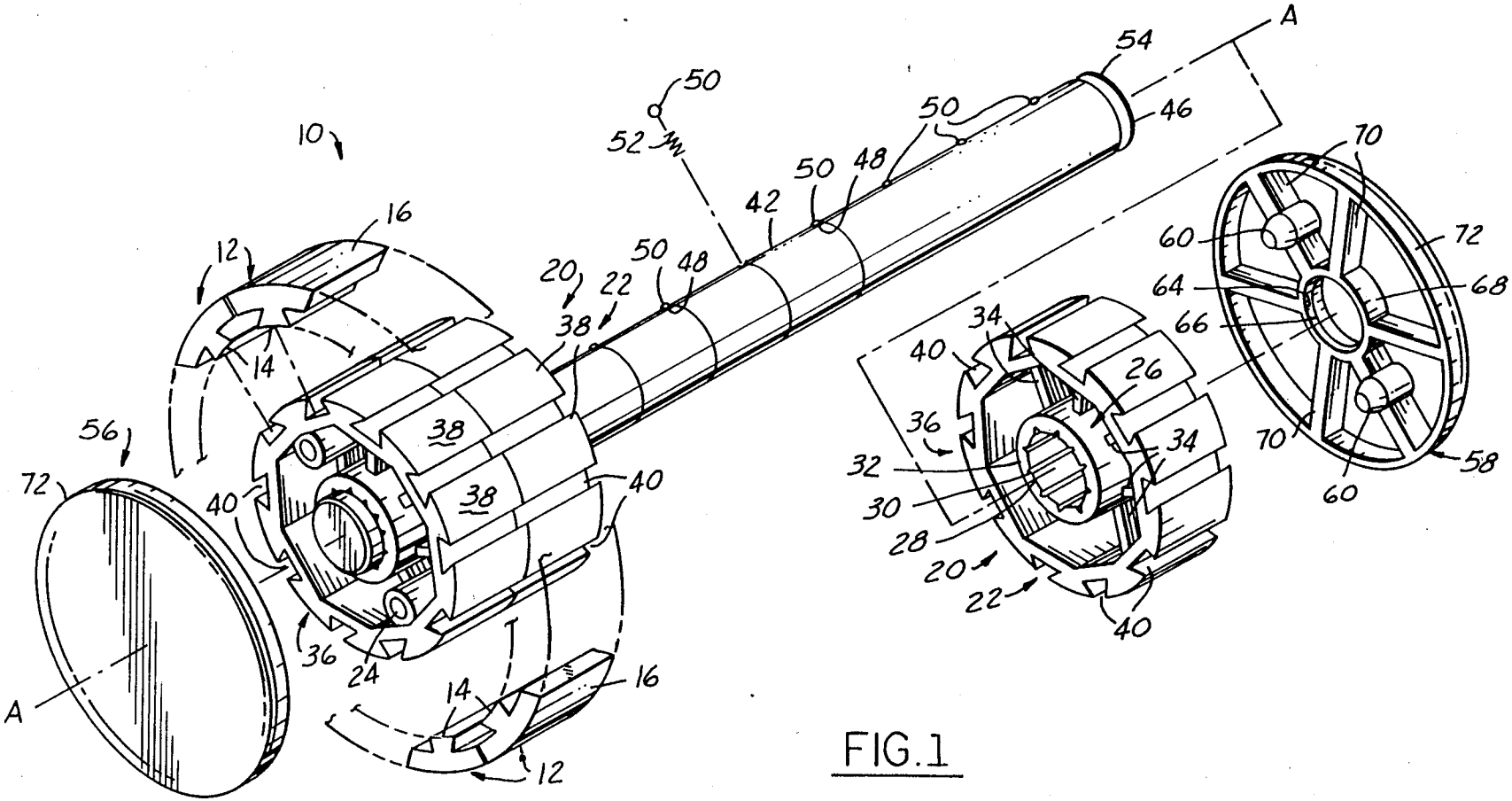
FIG. 1 is an exploded partial isometric of the puzzle.

To introduce the overall structure of the present invention, reference will first be made to FIGS. 1 and 2. In these figures, a self-contained cylindrical puzzle is generally indicated by reference numeral 10.

The puzzle has a plurality of slide elements 12. As best can be seen in FIG. 1, each slide element 12 has a dove tail tenon 14 which projects radially inwardly to an axis A—A. Each slide element 12 includes a curved face 16 which has indicia on it. The curved face 16 projects radially outwardly from the axis A—A.

The faces 16 of the slide elements 12 form a mosaic cylindrical surface characterized by the absence of one of the slide elements 12 and its face 16. This absence leaves a slot 18 in one position on the cylindrical surface into which one of the plurality of slide elements 12 may be slid. When the one slide element 12 is slid into slot 18, it will leave another slot in the position from which slide element 12 was slid.

Figure 2:
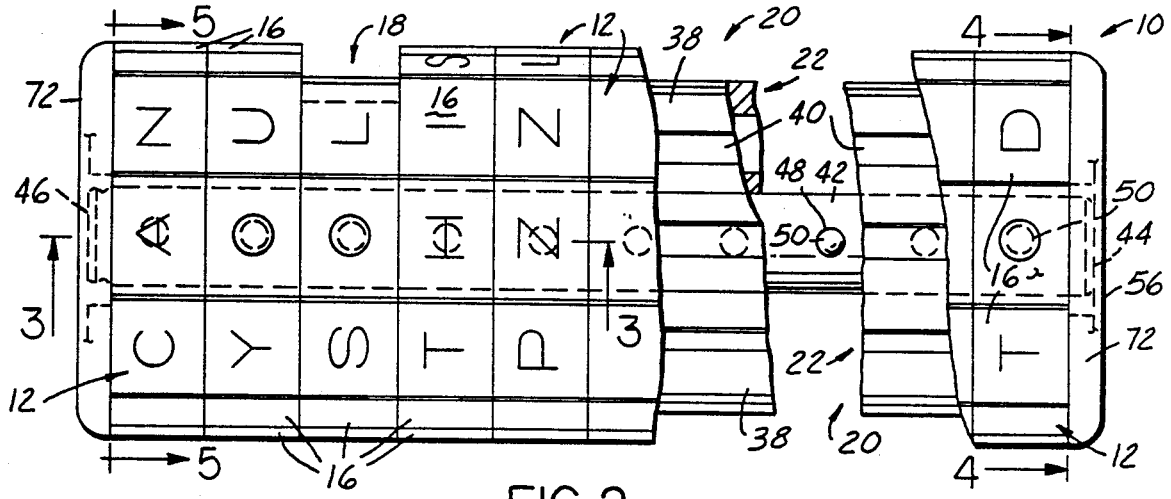
FIG. 2 is a side elevation of the puzzle.
Figure 3:
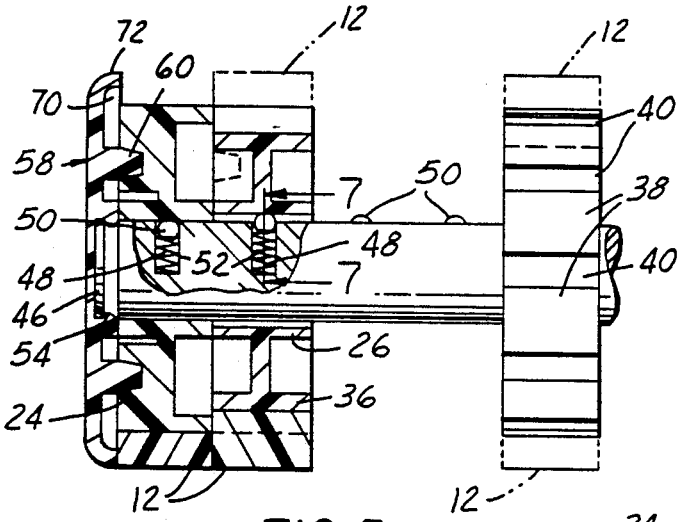
FIG. 3 is a partial sectional view shown in the direction of arrows 3—3 of FIG. 2.
Figure 4:
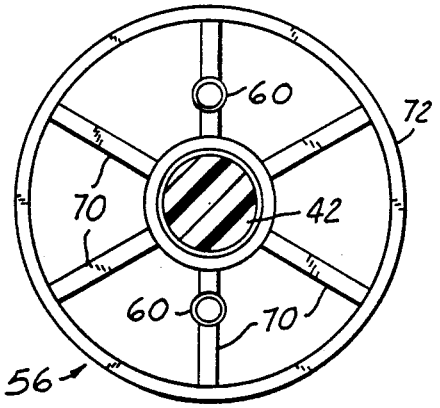
FIG. 4 is an end sectional view of the puzzle taken in the direction of arrows 4—4 of FIG. 2.
Figure 7:
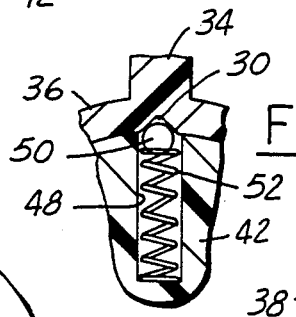
FIG. 7 is a detailed sectional view taken in the direction of arrows 7—7 of FIG. 3.
Figure 5:
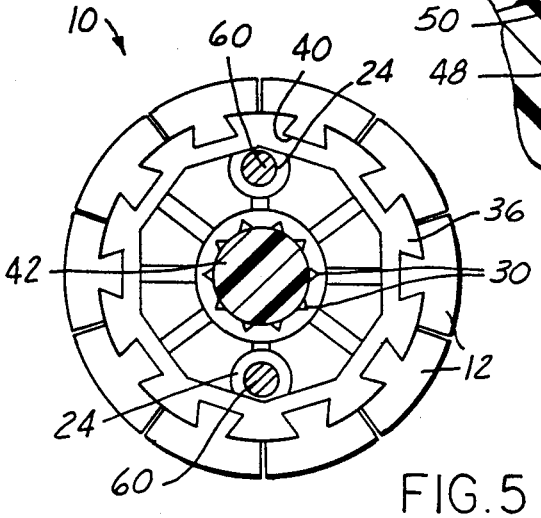
FIG. 5 is an end sectional view of the puzzle taken in the direction of arrows 5—5 of FIG. 2.
Figure 6:
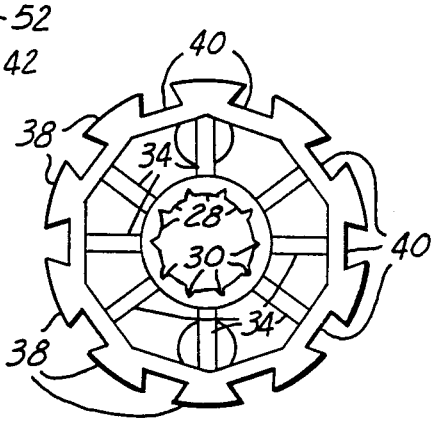
FIG. 6 is an end view of a base structure revealed in FIG. 1.

The particular means by which slide elements 12 may slide into positions left by slots, as for example slot 18 shown in FIG. 2, is afforded by a base structure referred to generally in FIGS. 1 and 6 by reference numeral 20. The base structure 20 keeps the faces 16 of the slide elements 12 in registry as components of the cylindrical surface. The base structure 20 also restricts the slide elements 12 so that a slide element 12 is only capable of sliding in a direction parallel to the central axis A—A into a slot 18, when the slot 18 is availably juxtaposed to the element 12. More particularly, the base structure 20 comprises a multiplicity of rotatable base wheels 22 aligned end-to-end concentrically about the axis A—A. At least one rotatable base wheel 22 is disposed at each end of the aligned multiplicity of base wheels 22 and is accordingly an end rotatable base wheel 22. The end rotatable base wheel 22 is characterized by its having at least one female fitting 24 that opens toward the end of the aligned multiplicity of rotatable base wheels 22. Preferably, for manufacturing convenience, this feature characterizes all of the rotatable base wheels 22, although the feature is relevant only to the end rotatable base wheel 22.

Each base wheel 22 includes a cylindrical hub collar 26 of determinable length. Hub collar 26 has a hub inner surface 28 which faces radially inwardly and in which a plurality of detent grooves 30 are disposed parallel to and spaced concentrically about axis A—A. Hub collar 26 has an outer surface 32 from which a plurality of planar spokes 34 radiate.

Each base wheel 22 includes an outer collar 36 to which planar spokes 34 radiate. Outer collar 36 is disposed concentrically about hub collar 26, with a surface 38 facing radially outwardly. Surface 38 has a plurality of mortise grooves 40 which are disposed parallel to and concentrically about axis A—A. The dove tail tenon 14 of each slide element 12 is insertable into, retainable by, and slidable along a mortise groove 40 of an outer collar 36. As the dove tail tenon 14 of each slide element 12 is slidable along a mortise grooves 40 of an outer collar 36, it is slidable from a mortise groove 40 of one outer collar 36 to the mortise groove 40 of another, when the mortise groove 40 of one outer collar 36 and the mortise groove 40 of the other are aligned.

An axle 42 has two ends 44 and 46. Axle 42 extends between ends 44 and 46 along axis A—A, through cylindrical hub collars 26 of the multiplicity of rotatable base wheels 22. Base wheels 22 are accordingly rotatable about axis 42. Axle 42 has detent means comprising a multiplicity of sockets 48 in axle 42, which are spaced discretely from one another, generally by the determinant length of hub collar 26. Sockets 48 are aligned parallel to axis A—A. Each socket 48 receives therein a cammable detent 50 and a means, a spring 52 as shown, biasing the detent 50 radially outwardly. When base wheel 22 is rotated so as to bring the detent groove 30 into alignment with the detent 50, detent 50 is biased into a detent groove 30 in the inner surface 28 of hub collar 26. The detent 50 is cammable out of the detent groove 30. Finally, axle 42 has a retention means on each end 44 and 46. Preferably, the retention means comprises a lip 54 disposed generally at each end 44 and 46 and functions cooperatively with end caps 56 and 58 having a structure now to be disclosed. End caps 56 and 58 are at each end 44 and 46. Each end cap 56 and 58 has at least one male insert 60, here two are shown in end cap 58, alignable with a respective female fitting 24 of an end rotatable base wheel 22 and fittable thereinto. Each end cap 56 or 58 includes a cylindrical hub rib 62, which has a hub rib inner surface 64. The hub rib inner surface 64 faces radially inwardly. A concentric retention groove 66 is disposed in the inner surface 64. The retention means of the axle 42, that is, lip 54, is snap-fittable into retention groove 66. Hub rib 62 has an outer surface 68, from which a plurality of spoke ribs 70 radiate. Each end cap 56 or 58 also includes an outer rim 72 which spoke ribs 70 radiate.

Puzzle 10 is a self-contained unit which may be manipulated by grasping the cylindrical surface at the outer face 16 of the slide elements 12 and rotating a row of slide elements 12 captured in a base wheel 22 relative to a row of slide elements 12 captured in another base wheel 22, so as to change angular or rotational alignments of the slide elements 12 on the one base wheel 22 with respect to the slide elements 12 on the other. By sliding a slide element 12 into the slot 18 at one position, the axial alignments of slide elements 12 with respect to one another are changed. Accordingly, indicia on the faces 16 of the slide elements 12 change their relative positions with respect to one another. A considered manipulation of the slide elements 12, angularly and axially with respect to one another so as to change the relative positions of the faces 16 of the slide elements and the indicia thereon, will cause the indicia on the faces 16 of the slide elements 12 to eventually be positioned so as to represent a solution to the puzzle 10.

Figure 8:
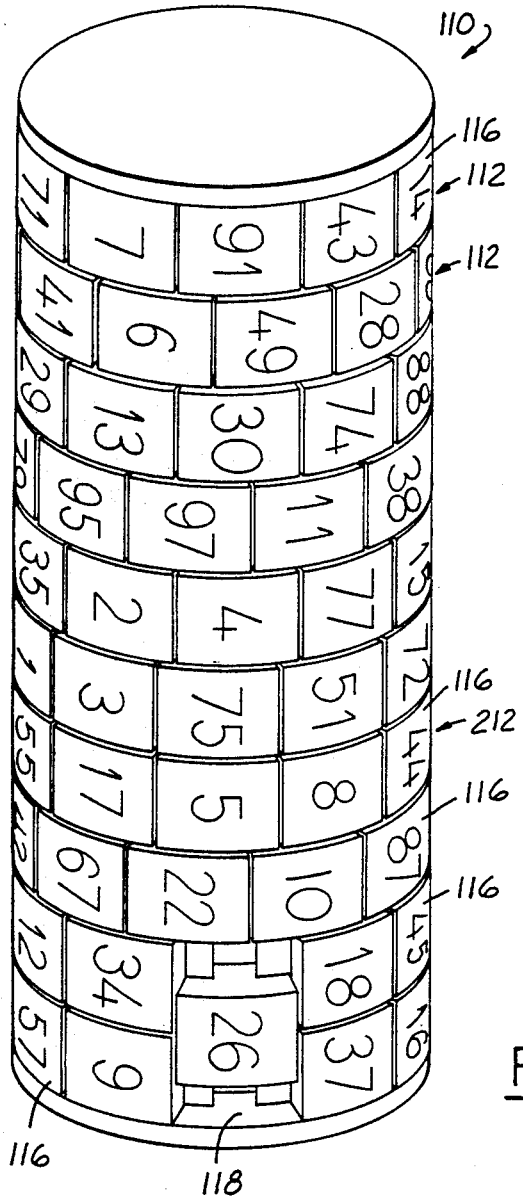
FIG. 8 is a perspective view of an embodiment of the invention which has a surface dress of numerical indicia.
Figure 9:
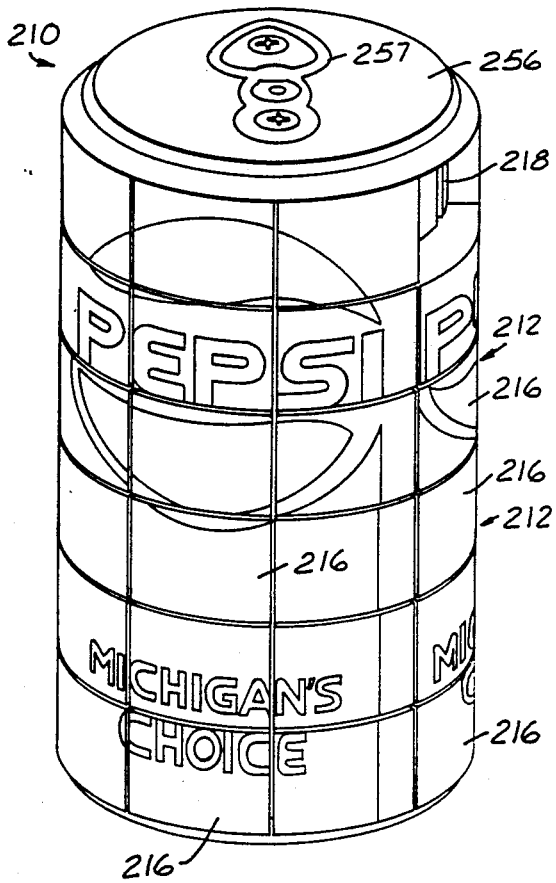
FIG. 9 is a perspective view of an embodiment of the invention which has a surface dress that is the trade dress of a popular beverage.

Referring now to FIGS. 8 and 9, a self-contained puzzle is indicated in FIG. 8 as being generally at 110, and in FIG. 9, as being generally at 210. Either of the puzzles 110 or 210 may be grasped at the outer faces 116 or 216 and each row of puzzles 110 or 210, which contains slide elements 112 or 212, may be rotated to change angular or rotational alignments of the slide elements 112 or 212 captured by a base wheel 122 or 222 with respect to slide elements 112 or 210 captured by other base wheels 122 and 222 of puzzles 110 or 210. By sliding a slide element 112 or 212 into a slot at one position, here shown as at 118 or 218, the axial alignments of slide elements 112 or 212 with respect to one another are changed. Accordingly, indicia of the faces 116 or 216 of the slide elements 112 or 212 change their relative positions with respect to one another. For puzzles 110 or 210 the considered manipulation of the slide elements 112 or 212, angularly and axially with respect to one another so as to change the relative positions of the faces 116 or 216 of the slide elements 112 or 212 and the indicia thereon, will cause the indicia of the faces 116 or 216 of the slide elements 112 or 212 to eventually be positioned in a solution to the puzzles 110 or 210.

Solutions may be the result of simple operations involving aligning color indicia into rows, each row being an alignment of slide elements 12 concentrically about a base wheel 22, or columns, each column being an axial alignment of slide elements 12. Solutions may also be graphic representations arrived at by having each slide element 12 in a predetermined position with respect to all other slide elements to effect a sequential positioning of numerical indicia as shown in FIG. 8. An overall pictorial representation with each face 16 carrying a small portion of the picture may also effect a solution. In one particular embodiment, shown in FIG. 9, the indicia, which on each face 116 is a color graphic, may be arranged to display the trade dress of a popular beverage can. To render a realistic illusion of the popular beverage can, the puzzle 110 has at least one end cap 256 that has a three dimensional form or graphic representation of a can top, as for example the tab-top 257 shown in FIG. 9. Such a range of solutions provides amusement for a range of operators, from young children to adults, the amusement draws such attention to the indicia that the puzzle provides a vehicle for displaying promotional indicia.

I claim:

1. A self-contained puzzle comprising:

a plurality of slide elements, each slide element having a dove tail tenon projecting radially inwardly to an axis and each slide element including a curved face having indicia thereon and projecting radially outwardly from said axis, all of the faces of the slide elements generally forming together a mosaic cylinder about said axis, the cylinder characterized by the absence of at least element, leaving a slot in one position on the cylinder into which slot one of the plurality of slide elements is slidable to leave a slot in another position on the cylinder;

a multiplicity of rotatable base wheels aligned end to end concentrically about said axis, including at least one end rotatable base wheel disposed at each end of the aligned multiplicity of rotatable base wheels, each at least one end rotatable base wheel having at least one female fitting that opens toward the end of the aligned multiplicity of rotatable base wheels at which said at least one end rotatable base wheel is disposed, each base wheel including a cylindrical hub collar of a determinate length, the hub collar having a hub inner surface which faces radially inwardly and in which a plurality of detent grooves are disposed parallel to and spaced concentrically about said axis and having an outer surface from which a plurality of planar spokes radiate and each base wheel including an outer collar to which said planar spokes radiate, the outer collar being disposed concentrically about the hub collar and the outer collar having a surface which faces radially outwardly and in which a plurality of mortise grooves are disposed parallel to and concentrically about said axis, the dove tail tenon of each slide element being insertable into, retainable by, and slidable along a mortise groove of an outer collar and being slidable from a mortise groove of one outer collar to the mortise groove of another when the mortise groove of said one outer collar and the mortise groove of said another are aligned;

an axle having two ends, the axle extending between said two ends along said axis through the cylindrical hub collars of the multiplicity of rotatable base wheels so that the base wheels are rotatable about the axle, the axle having detent means comprising a multiplicity of sockets in the axle, the sockets spaced discretely from one another by said determinate length and aligned in a line that is parallel to said axis, each socket receiving therein a cammable detent and a means biasing the detent radially outwardly into a detent groove in the inner surface of a hub collar when the base wheel is rotated so as to bring said detent groove into alignment with said detent means, the detent being cammable out of said detent groove, and the axle having a retention means on each end thereof, the retention means comprising a lip disposed generally at a respective end of the aligned multiplicity of rotatable base wheels; and end caps, each end cap having at least one male insert alignable with a respective female fitting of an end rotatable base wheel and fittable thereinto, each end cap including a cylindrical hub rib having a hub rib inner surface which faces radially inwardly and in which a concentric retention groove is disposed into which the retention means of the axle is snap fittable and having an outer surface from which a plurality of spoke ribs radiate, and each end cap including an outer rim to which said rib spokes radiate, whereby, the puzzle is a self contained unit which may be manipulated by rotating the base wheels so as to change angular alignments of the slide elements on one base wheel with respect to the slide elements on another and by sliding a slide element into the slot at one position so as to change axial alignments of the slide elements with respect to one another so that the indicia may be on the faces of the slide elements may be positioned to represent a solution for the puzzle.

2. The puzzle of claim 1 wherein at least one end cap is formed as the top of a beverage can.

3. The puzzle of claim 2 wherein the solution is a representation of the trade dress of a popular beverage can.

4. The puzzle of claim 1 wherein at least one end cap contains indicia representing the top of a beverage can.

5. The puzzle of claim 4 wherein the solution is a representation of the trade dress of a popular beverage can.

6. A self-contained puzzle comprising:

a plurality of slide elements, each slide element having tenon means projecting radially inwardly to an axis and each slide element including a face having indicia thereon and projecting radially outwardly from said axis, all of the faces of the slide elements generally forming together a mosaic structure about said axis, the structure characterized by the absence of at least element, leaving a slot in one position on the structure into which slot one of the plurality of slide elements is slidable to leave a slot in another position on the structure;

a multiplicity of rotatable base means aligned end to end concentrically about said axis, each rotatable base means having an inner surface which faces radially inwardly and in which a plurality of detent grooves are disposed parallel to and spaced concentrically about said axis and having an outer surface which faces radially outwardly and in which a plurality of mortise grooves are disposed parallel to and generally concentrically about said axis, the tenon means of each slide element being insertable into, retainable by, and slidable along a mortise groove of a rotatable base means and being slidable from a mortise groove of one rotatable base means to the mortise groove of another rotatable base means when the mortise groove of said one rotatable base means and the mortise groove of said another rotatable base means are aligned, the multiplicity of rotatable base means including at least one end rotatable base means disposed at each end of the aligned multiplicity of rotatable base means, each at least one end rotatable base means having at least one base connecting means, said base connecting means being a female fitting that opens toward the end of the aligned multiplicity of rotatable base means at which said at least one end rotatable base means is disposed; and an axle having two ends, the axle extending between said two ends along said axis, said axle being surrounded by the inner surface of each rotatable base means so that each base means is rotatable about the axle, the axle having detent means comprising a multiplicity of sockets in the axle, the sockets spaced discretely from one another by a determinate length and aligned in a line that is parallel to said axis, each socket receiving therein a cammable detent and a means biasing the detent radially outwardly into a detent groove in the inner surface of a rotatable base means when the rotatable base means is rotated so as to bring said detent groove into alignment with said detent means, the detent being cammable out of said detent groove, said axle having an axle retention means on each end thereof, the puzzle further comprising end caps, each end cap having at least one end cap connecting means connectable with said base connecting means and each end cap having an end cap retention means that cooperates with said axle retention means to retain said end caps on the ends of said axle, said end cap connecting means being a male insert alignable with a respective female fitting of an end rotatable base means and fittable thereinto and wherein each end cap retention means includes an inner surface which faces radially inwardly and projects parallel to said axis, said end cap inner surface including a concentric retention groove into which the retention means of the axle is snap fittable, said axle retention means comprising a lip disposed on the axle generally at a respective end of the aligned multiplicity of rotatable base means, whereby, the puzzle is a self contained unit which may be manipulated by rotating the rotatable base means so as to change angular alignments of the slide elements on one rotatable base means with respect to the slide elements on another rotatable base means and by sliding a slide element into the slot at one position so as to change axial alignments of the slide elements with respect to one another so that the indicia may be on the faces of the slide elements may be positioned to represent a solution for the puzzle.

7. The puzzle of claim 6 wherein the tenon means is a dove tail tenon.

8. The puzzle of claim 7 wherein each rotatable base means is a wheel.

9. The puzzle of claim 8 wherein the structure is a cylinder and wherein each rotatable base wheel includes a cylinder hub collar of said determinate length and wherein the inner surface of each rotatable base wheel is an inner surface of the hub collar, said inner surface of the hub collar facing radially inwardly, said axle extending through the cylindrical hub collars of the multiplicity of rotatable base wheels, the hub collar having an outer surface from which a plurality of planar spokes radiate, each rotatable base wheel including an outer collar to which said planar spokes radiate, the outer collar being disposed concentrically about the hub collar, and wherein the outer surface of each rotatable base wheel is the outer surface of the outer collar.

10. The puzzle of claim 9 wherein each end cap includes a cylindrical hub rib and wherein the inner surface of said each end cap is the inner surface of the hub rib, said hub rib inner surface facing radially inwardly, said hub rib having an outer surface from which a plurality of spoke ribs radiate, and wherein each end cap includes an outer rim to which said rib spokes radiate.

* * * * *